US009726036B2

(12) United States Patent
Ertz et al.

(10) Patent No.: US 9,726,036 B2
(45) Date of Patent: Aug. 8, 2017

(54) BI-METALLIC CONTAINMENT RING

(71) Applicant: HONEYWELL INTERNATIONAL INC., Morristown, NJ (US)

(72) Inventors: Timothy Ertz, Scottsdale, AZ (US); David T. Bailey, Chandler, AZ (US); Reha Gomuc, Phoenix, AZ (US)

(73) Assignee: HONEYWELL INTERNATIONAL INC., Morris Plain, NJ (US)

( * ) Notice: Subject to any disclaimer, the term of this patent is extended or adjusted under 35 U.S.C. 154(b) by 133 days.

(21) Appl. No.: 14/686,484

(22) Filed: Apr. 14, 2015

(65) Prior Publication Data

US 2016/0305275 A1 Oct. 20, 2016

(51) Int. Cl.
*F01D 21/04* (2006.01)
*F01D 5/02* (2006.01)

(52) U.S. Cl.
CPC ..... *F01D 21/045* (2013.01); *F01D 5/02* (2013.01); *F05D 2220/32* (2013.01); *F05D 2240/24* (2013.01)

(58) Field of Classification Search
CPC ..... F01D 21/04
See application file for complete search history.

(56) References Cited

U.S. PATENT DOCUMENTS 5,601,406 A 2/1997 Chan et al.
6,224,321 B1 5/2001 Ebden et al.
7,597,040 B2 * 10/2009 Gabrys ..... B32B 3/18 89/36.01
8,087,874 B2 1/2012 Jardine et al.
8,807,918 B2 8/2014 Hagshenas
2008/0199301 A1 8/2008 Cardarella
2014/0102164 A1 4/2014 Ganesh et al.

FOREIGN PATENT DOCUMENTS

EP 2594742 A1 5/2013
EP 2716873 A2 9/2014

OTHER PUBLICATIONS

Simchi, A., "Densification and microstructural evolution during co-sintering of Ni-base superalloy powders," Metallurgical and Materials Transactions A , Aug. 1, 2006, vol. 37, Issue 8 , pp. 2549-2557.
Extended EP Search Report for Application No. 16163766.5-1610 dated Dec. 9, 2016.

* cited by examiner

*Primary Examiner* — Adam Krupicka
(74) *Attorney, Agent, or Firm* — Lorenz & Kopf, LLP

(57) ABSTRACT

Apparatuses are provided for a containment ring. The containment ring includes a first portion having a first ring composed of a first material with a first ductility. The containment ring also includes a second portion coupled to the first ring. The second portion is composed of a second material having a second ductility that is less than the first ductility and the first ductility is greater than about forty percent elongation.

14 Claims, 10 Drawing Sheets

BI-METALLIC CONTAINMENT RING

TECHNICAL FIELD

The present disclosure generally relates to containment rings for use with gas turbine engines, and more particularly relates to a bi-metallic containment ring.

BACKGROUND

Containment rings can be employed with certain rotating devices to contain the rotating device during operation. For example, gas turbine engines include turbines and compressors. The turbines and compressors associated with the gas turbine engine can each include rotors, which can rotate at high speeds. In certain instances, each of the rotors can be surrounded by a containment ring, which can ensure the safe operation of the turbine and/or compressor. Generally, the containment of rotors is subject to federal requirements. In order to comply with the federal requirements, containment rings may have a large mass.

Accordingly, it is desirable to provide a bi-metallic containment ring that meets or exceeds federal requirements and has a reduced mass. Furthermore, other desirable features and characteristics of the present invention will become apparent from the subsequent detailed description and the appended claims, taken in conjunction with the accompanying drawings and the foregoing technical field and background.

SUMMARY

According to various embodiments, a containment ring is provided. The containment ring comprises a first portion including a first ring composed of a first material having a first ductility. The containment ring also comprises a second portion coupled to the first ring. The second portion is composed of a second material having a second ductility that is less than the first ductility and the first ductility is greater than about forty percent elongation.

Provided according to various embodiment is a containment ring. The containment ring comprises a first ring composed of a first material having a first ductility and a first strength. The containment ring also comprises a second ring coupled to the first ring. The second ring is composed of a second material having a second ductility that is different than the first ductility and a second strength that is different than the first strength. The first ductility is greater than about forty percent elongation and the first strength is less than about 100 kilopound per square inch.

Also provided according to various embodiments is a containment ring. The containment ring comprises a first ring composed of a first metal having a first ductility. The first ring has a first surface opposite a second surface. The containment ring also comprises a second ring coupled to the first surface of the first ring. The second ring is composed of a second metal having a second ductility that is different than the first ductility and the first ductility is greater than about forty percent elongation. The containment ring comprises a third ring coupled to the second surface of the first ring, and the third ring composed of the second metal.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description. In addition, those skilled in the art will appreciate that embodiments of the containment ring of the present disclosure may be practiced in conjunction with any type of structure or device requiring containment during operation, and that the example of a gas turbine engine having a turbine described herein is merely one exemplary embodiment of the present disclosure. It should be noted that many alternative or additional functional relationships or physical connections may be present in an embodiment of the present disclosure.

Figure 1:
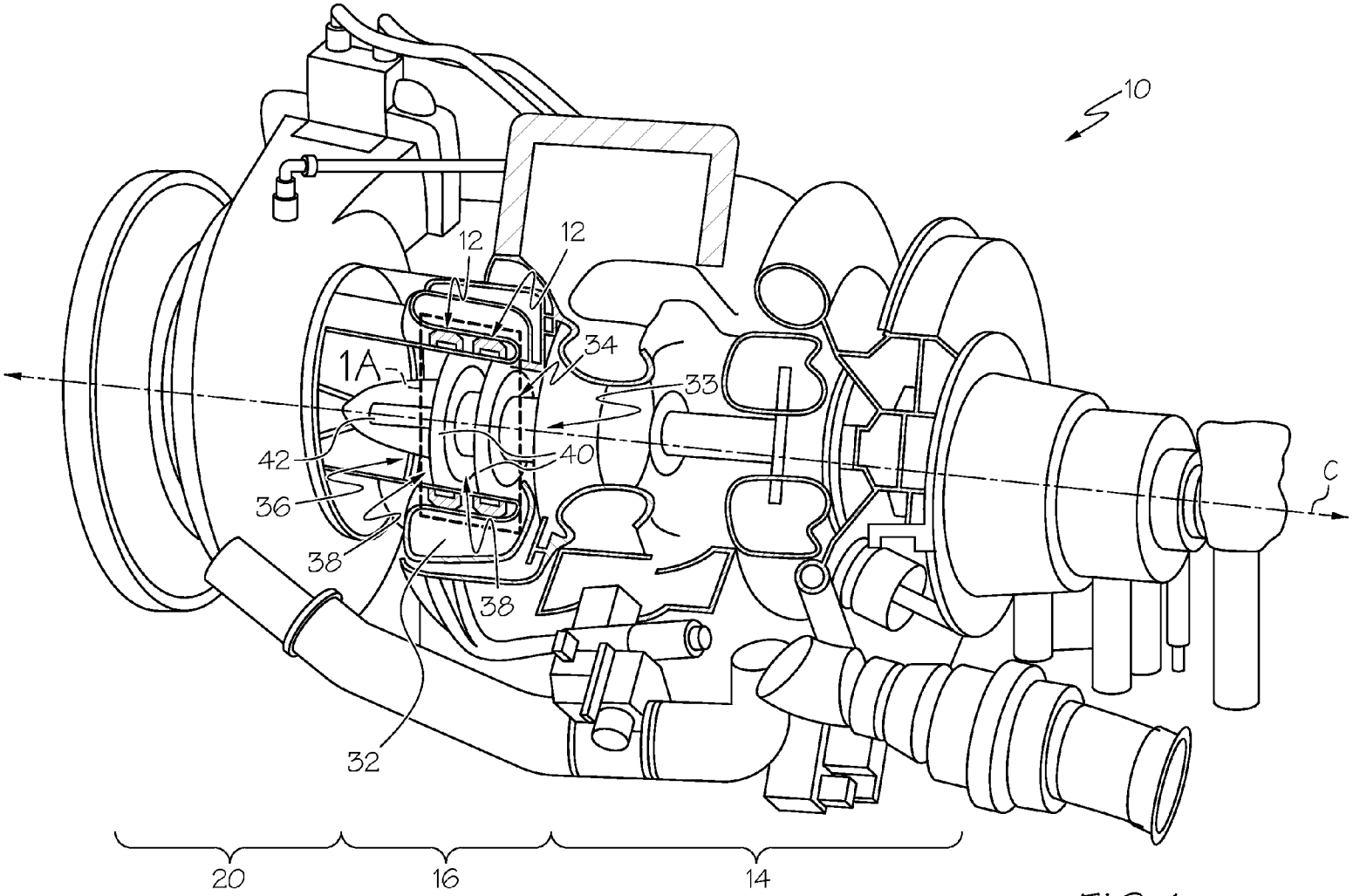
FIG. 1 is a partially cut-away schematic illustration of a gas turbine engine that includes a bi-metallic containment ring in accordance with various embodiments.

With reference to FIG. 1, an exemplary gas turbine engine 10 is shown, which includes a bi-metallic containment ring 12 according to various embodiments. It should be noted that the use of the bi-metallic containment ring 12 with the gas turbine engine 10 is merely exemplary, as the bi-metallic containment ring 12 described and illustrated herein can be employed to contain any suitable rotating structure, such as stationary axial compressors, stationary turbines, etc. In this example, the gas turbine engine 10 serves as an auxiliary power unit for power generation, and includes a compressor section 14, a combustion section and turbine section 16, and an exhaust section 20. In one example, the bi-metallic containment ring 12 is employed with the gas turbine engine 10 to provide tri-hub containment. It should be noted that while the bi-metallic containment ring 10 is described and illustrated herein as being employed with the gas turbine engine 10, such an auxiliary power unit, the bi-metallic containment ring described herein according to various embodiments can be employed with a gas turbine propulsion engine, such as a turbofan engine. It should be noted that although the figures shown herein depict an example with certain arrangements of elements, additional intervening elements, devices, features, or components may be present in an actual embodiment. It should also be understood that the figures are merely illustrative and may not be drawn to scale.

With reference to FIG. 1, the compressor section 14 includes at least one compressor, which draws air into the gas turbine engine 10 and raises the static pressure of the air. In the example of FIG. 1, the compressor section 14 includes at least one shaft mounted compressor, as known to one skilled in the art. While not illustrated herein, a rotor associated with the at least one compressor can be surrounded or substantially surrounded by the bi-metallic containment ring 12 according to various embodiments to contain a disk and/or blades associated with the rotor during the operation of the rotor. It should be noted that while the compressor section 14 is illustrated in FIG. 1 as including a gearbox, the compressor section 14 need not include a gearbox.

Figure 1A:
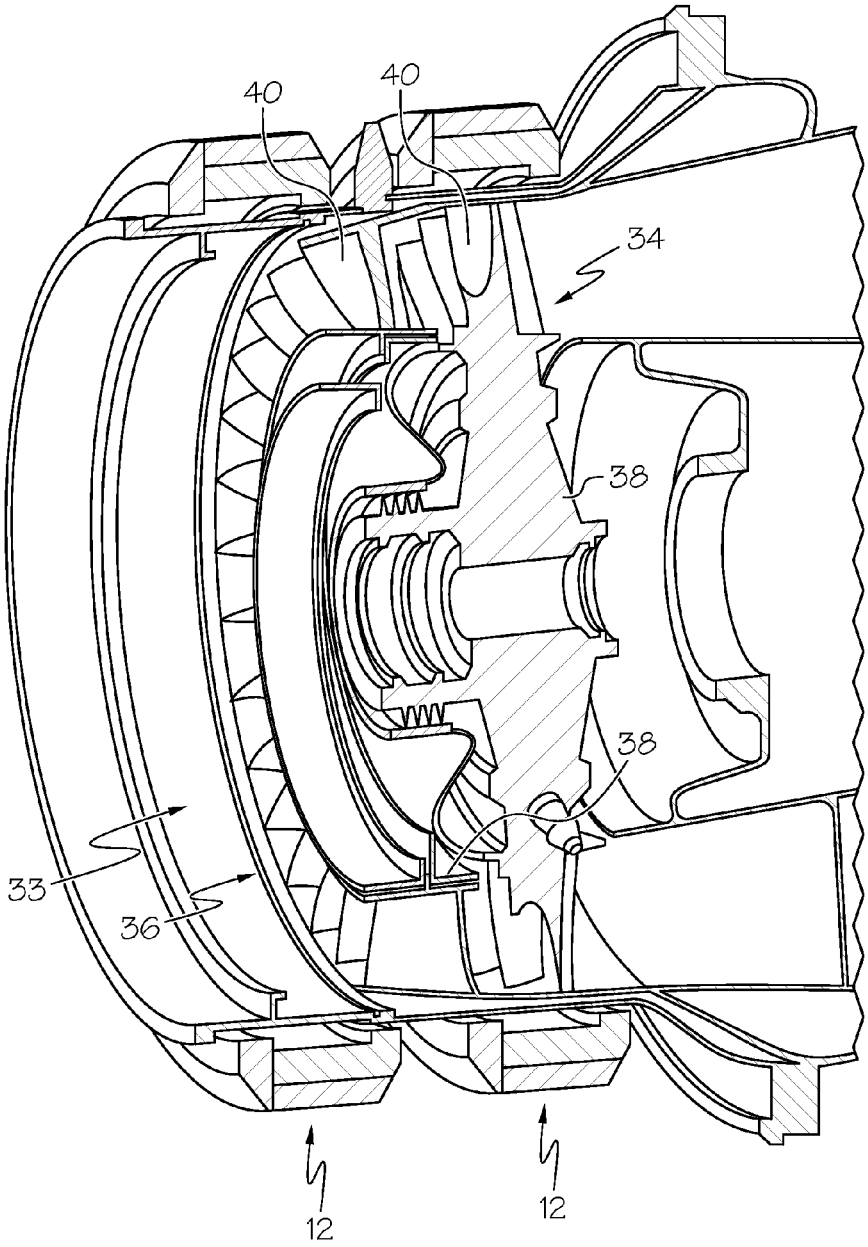
FIG. 1A is a simplified detail partially cut-away schematic illustration of a turbine section of the gas turbine engine of FIG. 1, taken from detail 1A in FIG. 1, which includes the bi-metallic containment ring in accordance with various embodiments.

The combustion section and turbine section 16 of gas turbine engine 10 includes a combustor 32 in which the high pressure air from the compressor section 14 is mixed with fuel and combusted to generate a combustion mixture of air and fuel. The combustion mixture is then directed into the turbine section 33. In this example, with reference to FIG. 1A, the turbine section 33 includes one or more turbines disposed in axial flow series. In one example, the turbine section 33 includes two turbines; a first stage turbine 34 and a second stage turbine 36. While two turbines are depicted, it is to be understood that any number of turbines may be included according to design specifics. Each of the turbines 34-36 includes a turbine disk 38, and the turbine disk 38 includes one or more turbine blades 40. With reference back to FIG. 1, the turbine disks 38 can be coupled to a power shaft 42 (FIG. 1). The combustion mixture from the combustion section 16 expands through each turbine 34-36, causing the turbine disks 38 to rotate. As the turbines 34-36 rotate, the turbines 34-36 rotate the power shaft 42, which may be used to drive various devices or components within the gas turbine engine 10 and/or a vehicle incorporating the gas turbine engine 10. As will be discussed in further detail herein, one or more of the turbines 34-36 can be substantially surrounded by the bi-metallic containment ring 12 according to various embodiments to contain the respective turbine disk 38 and/or turbine blades 40 during the operation of the respective turbine 34-36. The combustion mixture is then exhausted through the exhaust section 20.

Figure 2:
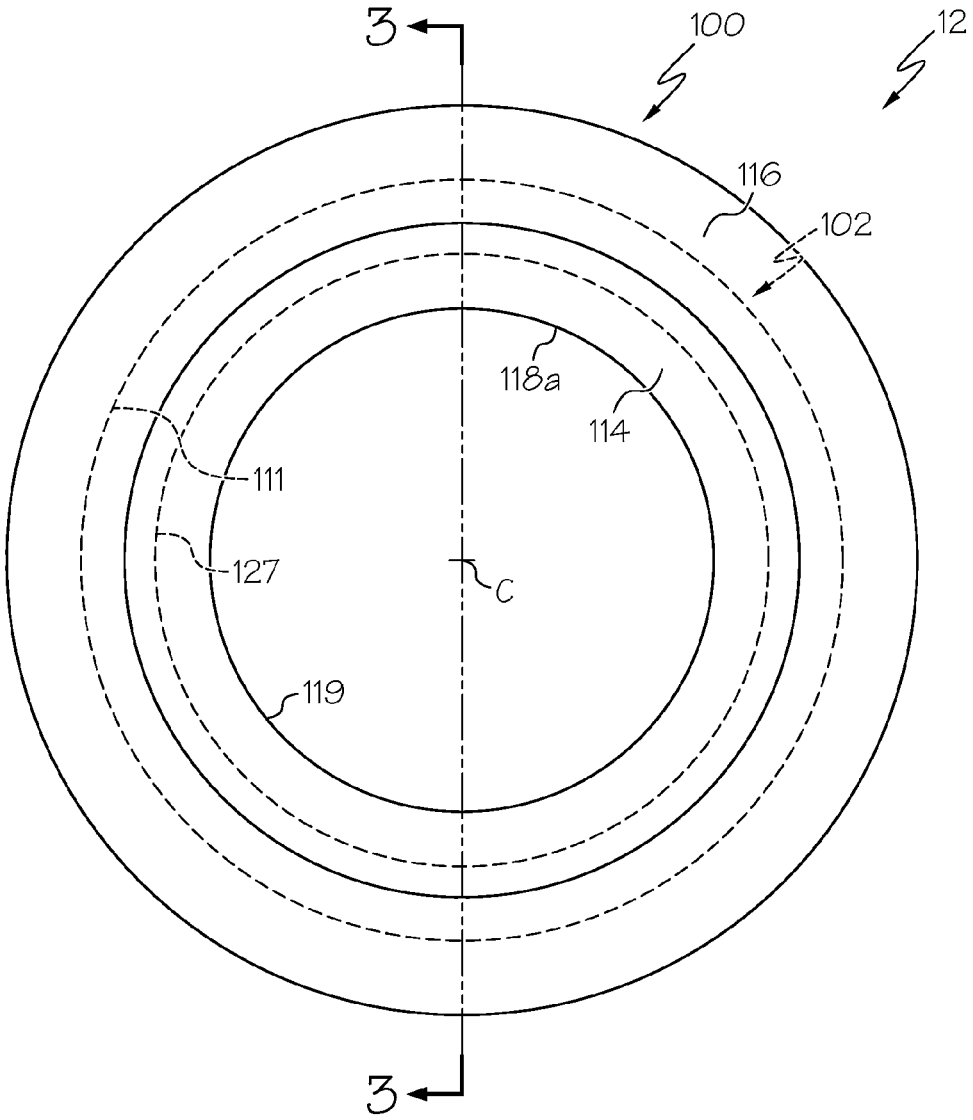
FIG. 2 is a front side view of the exemplary bi-metallic containment ring for use with the gas turbine engine of FIG. 1.

With reference to FIG. 2, a side view of the bi-metallic containment ring 12 according to various teachings of the present disclosure is shown. The bi-metallic containment ring 12 comprises a first portion 100 composed of a first material and a second portion 102 composed of a second, different material. In one example, the first portion 100 is composed of a high ductility, and a low strength material. It should be noted that throughout this application, the ductility of the material is defined as a percent elongation of the material. For example, the first portion 100 is composed of a material having a ductility or a percent elongation greater than about 40% elongation and a strength of less than about 100 kilopound per square inch (ksi). Exemplary materials for the first portion 100 can comprise Inconel® alloy 625 (IN625), CRES 347 stainless steel, etc.

In one example, the second portion 102 is composed of a low ductility and a high strength material. For example, the second portion 102 is composed of a material having a ductility or percent elongation of less than about 30% elongation and a strength of greater than about 150 kilopound per square inch (ksi). Exemplary materials for the second portion 102 can comprise Inconel® alloy 718 (IN718), Steel 17-4 PH®, etc. In one example, the first material of the first portion 100 can comprise about 25 percent by volume to about 75 percent by volume of the mass of the bi-metallic containment ring 12, and the second material of the second portion 102 can comprise about 75 percent by volume to about 25 percent by volume of the mass of the bi-metallic containment ring 12. Stated another way, the volume of the first material of the first portion 100 and the second material of the second portion 102 can be optimized to provide containment while minimizing a mass of the bi-metallic containment ring 12.

Figure 3:
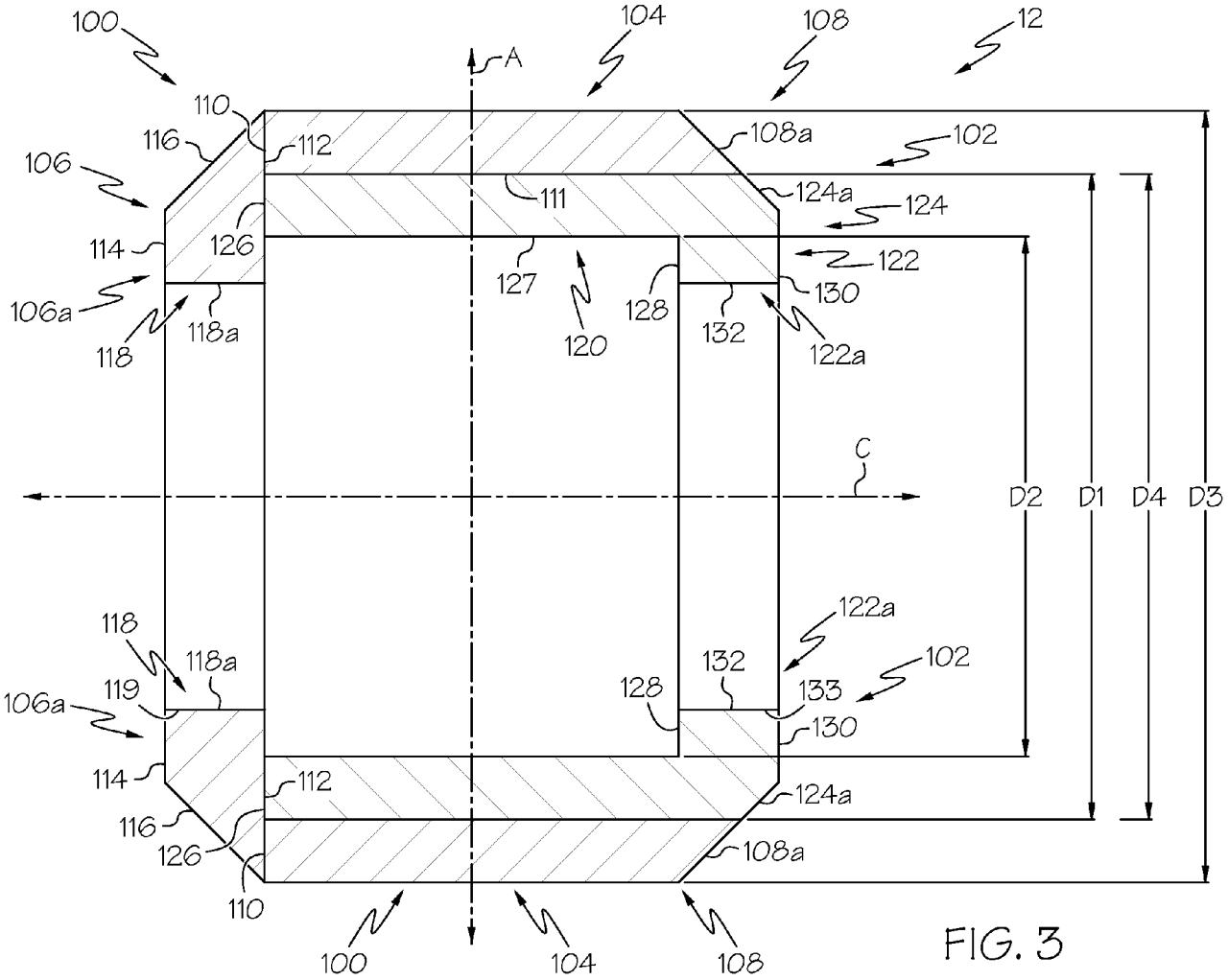
FIG. 3 is a cross-sectional view of the bi-metallic containment ring of FIG. 2, taken along line 3-3 of FIG. 2.

With reference to FIG. 3, FIG. 3 is a cross-sectional view taken through the side view of FIG. 2, which illustrates the bi-metallic containment ring 12 as positioned about the longitudinal centerline of the gas turbine engine 10. In FIG. 3, the first portion 100 comprises a first L-shaped ring having a first inner diameter D1 and a first outer diameter D3. It should be noted that while the first portion 100 is described and illustrated herein as having an L-shape in cross-section, the first portion 100 can have any desired shape, and thus, the L-shape is merely exemplary. The first portion 100 can include an annular body 104 and a retaining flange 106. The annular body 104 and the retaining flange 106 can be comprise a single piece, formed through a suitable forming process, such as casting, machining, etc. It will be understood, however, that the annular body 104 and the retaining flange 106 can be two separate pieces, joined together in a suitable post-processing step, such as welding, riveting, etc. Moreover, the use of the retaining flange 106 can be optional.

The first portion 100 can be substantially symmetric with respect to a longitudinal centerline axis C of the gas turbine engine 10 (FIG. 1), and can be substantially asymmetric with respect to a longitudinal axis A of the bi-metallic containment ring 12, which intersects the longitudinal centerline axis C. The annular body 104 can be substantially uniform, and can include a first side 108 opposite a second side 110, and can define a bore 111. The first side 108 can include a tapered edge 108*a*, however, the first side can have any desired shape. The second side 110 can be coupled to the retaining flange 106. The bore 111 can be sized and shaped to receive the second portion 102.

The retaining flange 106 can extend downwardly or radially inward from the annular body 104. The retaining flange 106 can comprise a forward retaining flange with regard to the location of the retaining flange 106 relative to the longitudinal centerline axis C. The retaining flange 106 has a first surface 112 and a second surface 114. The retaining flange 106 can taper from the first surface 112 to an area near the second surface 114 along a side 116, such that the first surface 112 has a greater length than the second surface 114 along the longitudinal axis A. The first surface 112 can be coupled to the second side 110 of the annular body 104. The second surface 114 can be opposite the first surface 112, and is coupled to the first surface 112 via the side 116 and a side 118. The side 118 can form a terminal end 118*a* of the retaining flange 106. The retaining flange 106 provides a lip or extension generally indicated by reference numeral 106*a* near the terminal end 118*a* that can aid in retaining the turbine disks 38 and turbine blades 40. The retaining flange 106 further defines a bore 119, which is sized to position the first portion 100 within the gas turbine engine 10.

The second portion 102 comprises a second L-shaped ring having a second inner diameter D2 and a second outer diameter D4. The second inner diameter D2 can be smaller than the first inner diameter D1, and the second outer diameter D4 can be slightly smaller than or about equal to the first inner diameter D1, such that the second portion 102 fits within the first portion 100. Generally, the second portion 102 fits within the first portion 100 so as to be concentric with the first portion 100. It should be noted that while the second portion 102 is described and illustrated herein as having an L-shape in cross-section, the second portion 102 can have any desired shape, and thus, the L-shape is merely exemplary. The second portion 102 can be substantially symmetric with respect to the longitudinal centerline axis C of the gas turbine engine 10 (FIG. 1), and can be substantially asymmetric with the longitudinal axis A of the bi-metallic containment ring 12.

The second portion 102 can include a second annular body 120 and a second retaining flange 122. The second annular body 120 and the second retaining flange 122 can be comprise a single piece, formed through a suitable forming process, such as casting, machining, etc. It will be understood, however, that the second annular body 120 and the second retaining flange 122 can be two separate pieces, joined together in a suitable post-processing step, such as welding, riveting, etc. Moreover, the use of the second retaining flange 122 can be optional.

The second annular body 120 can be substantially uniform. The second annular body 120 can include a first side 124 opposite a second side 126 and can define a bore 127. The first side 124 can include a tapered edge 124*a*, however, the first side 124 can have any desired shape. The tapered edge 124*a* of the second annular body 120 can have a slope substantially similar to a slope of the tapered edge 108*a* of the first side 108 of the annular body 104 to provide the bi-metallic containment ring 12 with a substantially consistent shape. The first side 124 can be coupled to the second retaining flange 122. The second side 126 can be adjacent and coupled to the first surface 112 of the retaining flange 106. The bore 127 is sized and shaped to enable the first portion 100 to be positioned about the turbine disks 38 and turbine blades 40.

The second retaining flange 122 can extend downwardly or radially inward from the first side 124 of the second annular body 120. The second retaining flange 122 can comprise an aft retaining flange with regard to the location of the second retaining flange 122 relative to the longitudinal centerline axis C. The second retaining flange 122 has a first side 128 and a second side 130, which can be interconnected via a terminal end 132. Generally, the terminal end 132 extends radially inward from the second annular body 120 for a distance such that the terminal end 132 is substantially coplanar with the terminal end 118*a* of the annular body 104 when viewed in cross-section. The second retaining flange 122 provides a lip or extension generally indicated by reference numeral 122*a* near the terminal end 132 that can aid in retaining the turbine disks 38 and turbine blades 40. The terminal end 132 is adjacent to a bore 133 defined through the second retaining flange 122. The bore 133 is sized to enable the second portion 102 to be positioned within the gas turbine engine 10. The second retaining flange 122 can also provide increased resistance against rolling of the bi-metallic containment ring 12 during a containment event. It should be noted that while the second retaining flange 122 is described and illustrated herein as being composed of the second material of the second portion 102, the second retaining flange 122 can be associated with or part of the first portion 100, if desired.

The first portion 100 of the bi-metallic containment ring 12 is coupled to the second portion 102 of the bi-metallic containment ring 12 through any suitable technique. For example, the first portion 100 and the second portion 102 can be formed separately and machined such that the first inner diameter D1 of the first portion 100 is substantially similar to the second outer diameter D4 of the second portion 102. Then, the first portion 100 is heated and the second portion 102 is chilled to enable the second portion 102 to be received within the first portion 100 to form an interference fit between the first portion 100 and the second portion 102 once assembled. Alternatively, the first portion 100 and the second portion 102 can be coupled together via an inertia weld, in which one of the first portion 100 and the second portion 102 is held fixed while the other of the first portion 100 and the second portion 102 is rotated or spun. Then, the fixed one of the first portion 100 and the second portion 102 can be inserted or pressed into the spun one of the first portion 100 and the second portion 102 to form the inertia weld between the first portion 100 and the second portion 102. As a further alternative, the first portion 100 and the second portion 102 can be coupled together via mechanical fasteners, such as one or more pins. The one or more pins can be inserted through the first portion 100 and the second portion at various locations along the diameter of the respective first portion 100 and the second portion 102. Coupling the first portion 100 and the second portion 102 with mechanical fasteners, such as pins, can enable the second portion 102 to move or rotate within the first portion 100, which can absorb energy during a containment event. In addition, the first portion 100 and the second portion 102 can be coupled together via hot isostatic pressing (HIP), as known to one skilled in the art.

With the first portion 100 coupled to the second portion 102 to define the bi-metallic containment ring 12, the bi-metallic containment ring 12 can be coupled to the gas turbine engine 10 so as to be positioned about a desired one or more of the turbine disks 38. During an event requiring containment of the turbine blades 40 and turbine disks 38, as the second material of the second portion 102 has a higher strength than the first material, the second portion 102 absorbs a significant amount of energy. If the second portion 102 fractures, the ductility of the first material of the first portion 100 enables the first portion 100 to expand and absorb energy to contain the turbine blades 40 and turbine disks 38. Thus, the bi-metallic containment ring 12 having the first portion 100 of the first, ductile material and the second portion 102 of the second, high strength material meets the requirements for containment, while providing a reduced mass of the bi-metallic containment ring 12. The reduced mass can provide weight savings for the gas turbine engine 10 and a vehicle employing the gas turbine engine 10 (FIG. 1).

The bi-metallic containment ring 12 discussed with regard to FIGS. 1-3 is merely one example of a bi-metallic containment ring that can be employed with the gas turbine engine 10. In accordance with various embodiments, with reference to FIG. 4, a side view of a bi-metallic containment ring 200 is shown. The bi-metallic containment ring 200 can be used with the gas turbine engine 10 in similar fashion to the bi-metallic containment ring 12 discussed above with regard to FIGS. 1-3, and further, the gas turbine engine 10 can include both the bi-metallic containment ring 12 and the bi-metallic containment ring 200, if desired. Thus, the gas turbine engine 10 need not employ a single type of bi-metallic containment ring 12, 200.

The bi-metallic containment ring 200 comprises a first portion 202 composed of a first material and a second portion 204 composed of a second, different material. In one example, the first portion 202 is composed of a high ductility or high percent elongation, and a low strength material. For example, the first portion 202 is composed of a material having a ductility or percent elongation greater than about 40% elongation and a strength of less than about 100 kilopound per square inch (ksi). Exemplary materials for the first portion 202 can comprise Inconel® alloy 625 (IN625), CRES 347 stainless steel, etc.

In one example, the second portion 204 is composed of a low ductility and a high strength material. For example, the second portion 204 is composed of a material having a ductility less than about 30% elongation and a strength of greater than about 150 kilopound per square inch (ksi). Exemplary materials for the second portion 204 can comprise Inconel® alloy 718 (IN718), Steel 17-4 PH®, etc. In one example, the first material of the first portion 202 can comprise about 25 percent by volume to about 75 percent by volume of the mass of the bi-metallic containment ring 200, and the second material of the second portion 204 can comprise about 75 percent by volume to about 25 percent by volume of the mass of the bi-metallic containment ring 200. Stated another way, the volume of the first material of the first portion 202 and the second material of the second portion 204 can be optimized to provide containment while minimizing a mass of the bi-metallic containment ring 200.

Figure 4:
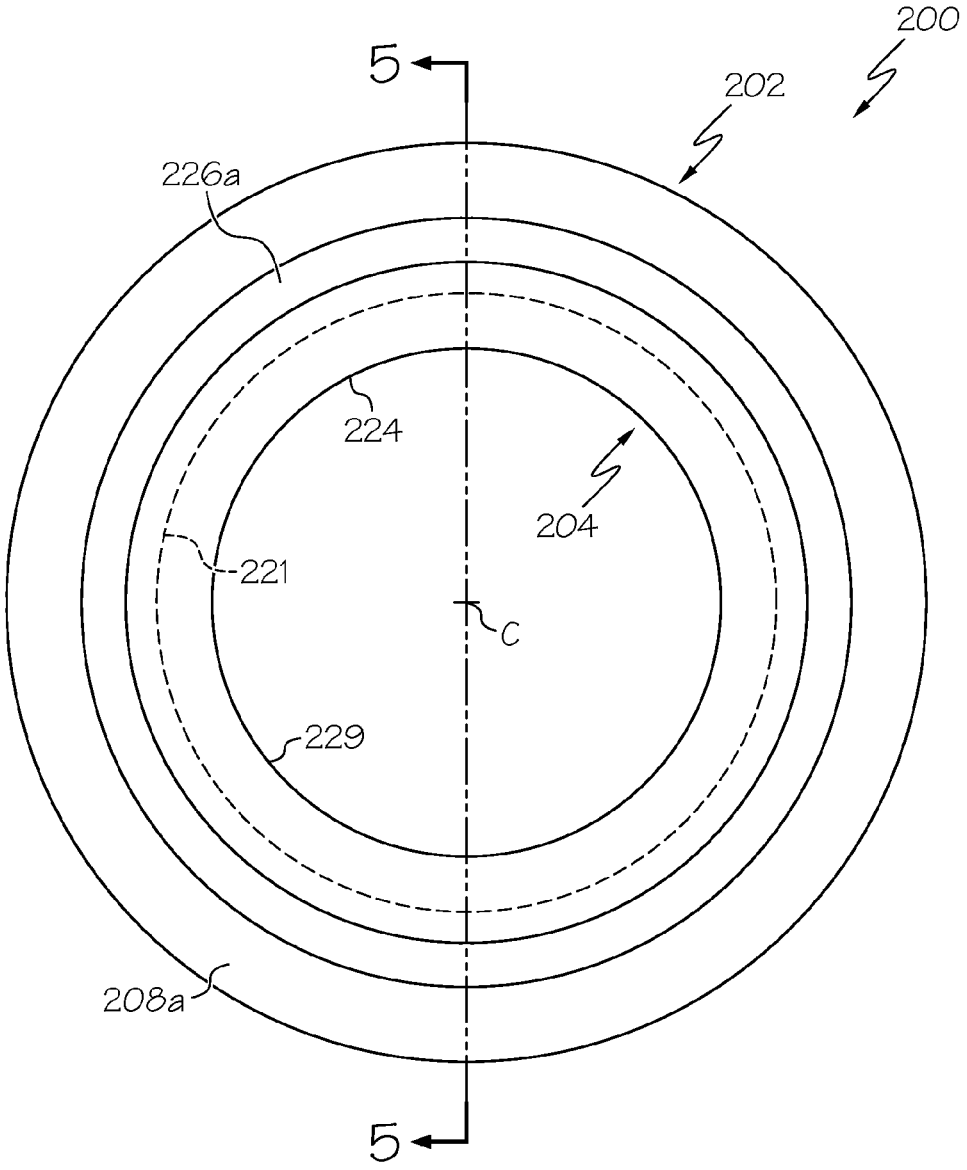
FIG. 4 is a front side view of an exemplary bi-metallic containment ring for use with the gas turbine engine of FIG. 1.
Figure 5:
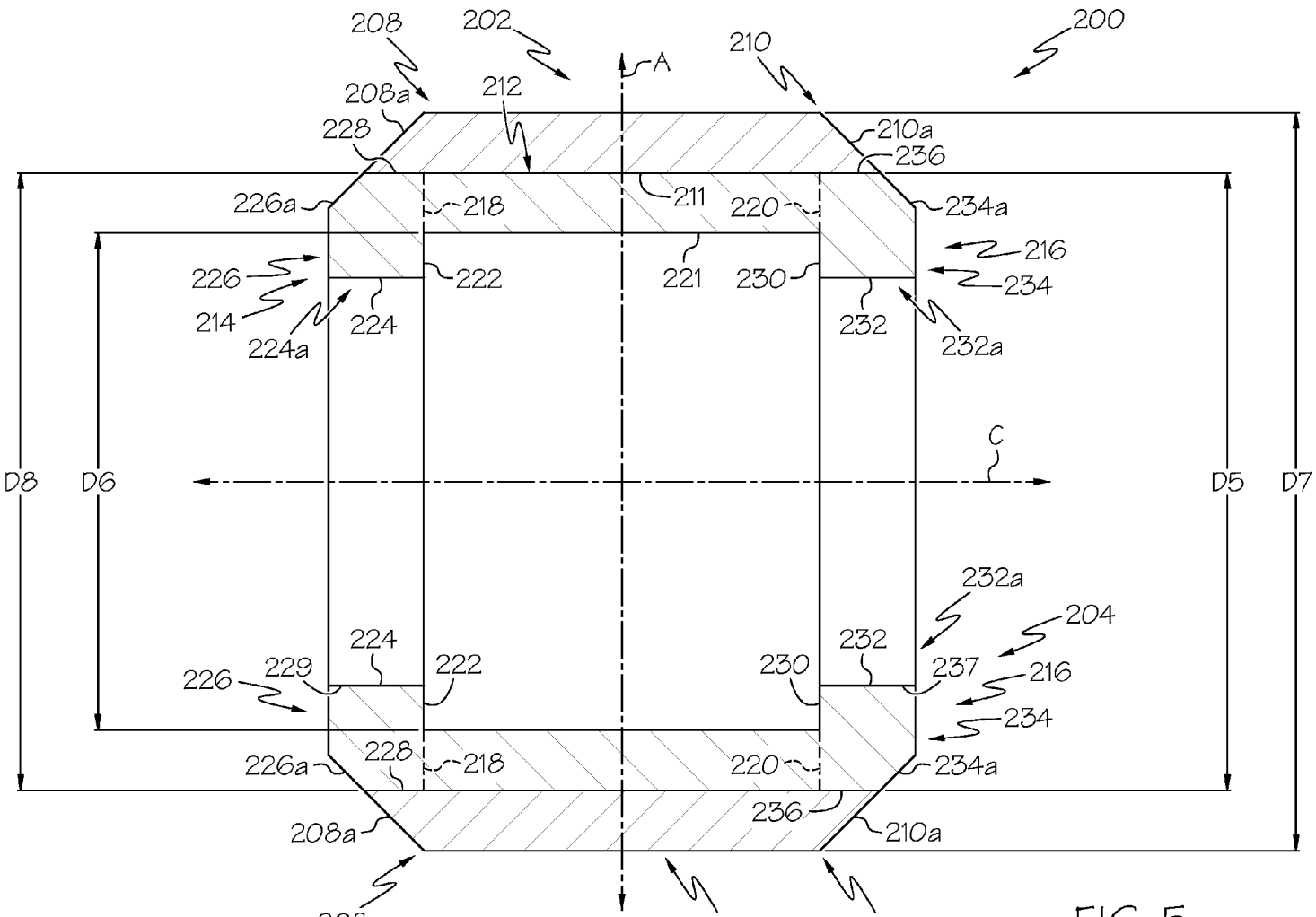
FIG. 5 is a cross-sectional view of the bi-metallic containment ring of FIG. 4, taken along line 5-5 of FIG. 4.

With reference to FIG. 5, FIG. 5 is a cross-sectional view taken through the side view of FIG. 4, which illustrates the bi-metallic containment ring 200 as positioned about the longitudinal centerline of the gas turbine engine 10. In FIG. 5, the first portion 202 comprises a first ring 206 having a first inner diameter D5 and a first outer diameter D7. The first ring 206 can comprise a single piece annular body, which can be formed through a suitable forming process, such as casting, machining, etc. The first ring 206 can be substantially symmetric with respect to the longitudinal centerline axis C of the gas turbine engine 10 (FIG. 1), and can be substantially symmetric with the longitudinal axis A of the bi-metallic containment ring 200. The first ring 206 can be substantially uniform. The first ring 206 can include a first side 208 opposite a second side 210, and defines a bore 211. The first side 208 can include a chamfered edge 208*a*, which can taper from the first outer diameter D7 to the first inner diameter D5; however, the first side 208 can have any desired shape. The second side 210 can include a chamfered edge 210*a*, which can taper from the first outer diameter D7 to the first inner diameter D5; however, the second side 210 can have any desired shape. The chamfered edge 208*a* and the chamfered edge 210*a* can taper at the same slope, or can taper at different slopes, if desired. The bore 211 receives the second portion 204 when the bi-metallic containment ring 200 is assembled.

The second portion 204 comprises a C-shaped ring having a second inner diameter D6 and a second outer diameter D8. The second inner diameter D6 can be smaller than the first inner diameter D5, and the second outer diameter D8 can be slightly smaller than or about equal to the first inner diameter D5, such that the second portion 204 fits within the first portion 202. Generally, the second portion 204 fits within the first portion 202 so as to be concentric with the first portion 202. It should be noted that while the second portion 204 is described and illustrated herein as having a C-shape, the second portion 204 can have any desired shape, and thus, the C-shape is merely exemplary. The second portion 204 can be substantially symmetric with respect to the longitudinal centerline axis C of the gas turbine engine 10 (FIG. 1), and can be substantially symmetric with the longitudinal axis A of the bi-metallic containment ring 200.

The second portion 204 can include a second annular body 212, a first retaining flange 214 and a second retaining flange 216. The second annular body 212, the first retaining flange 214 and the second retaining flange 216 comprise a single piece, formed through a suitable forming process, such as casting, machining, etc. It will be understood, however, that the second annular body 212, the first retaining flange 214 and the second retaining flange 216 can each be separate pieces, joined together in a suitable post-processing step, such as welding, riveting, etc. Moreover, the use of the first retaining flange 214 and the second retaining flange 216 can be optional. The second annular body 212 can be substantially uniform. The second annular body 212 can include a first side 218 opposite a second side 220, and defines a bore 221. The first side 218 is coupled to the first retaining flange 214, and the second side 220 is coupled to the second retaining flange 216. The bore 221 is sized to enable the bi-metallic containment ring 200 to be positioned about the turbine disks 38 and turbine blades 40.

The first retaining flange 214 can extend downwardly or radially inward from the first side 218 of the second annular body 212. The first retaining flange 214 can include a first side 222, a second side 224, a third side 226, a fourth side 228 and defines a bore 229. The first side 222 is coupled to the first side 218 of the second annular body 212. The second side 224 is coupled to the first side 222 of the first retaining flange 214 and the third side 226. The second side 224 forms a terminal end of the first retaining flange 214. The second side 224 extends radially outward for a distance from the second inner diameter D6 to a lip or extension generally indicated by reference numeral 224*a* near the terminal end that can aid in retaining the turbine disks 38 and turbine blades 40. The third side 226 is coupled to the second side 224, and is generally opposite the first side 222. The third side 226 includes a chamfered edge 226*a*, which tapers from the third side 226 to the fourth side 228 to interconnect the third side 226 and the fourth side 228. The chamfered edge 226*a* can taper at substantially the same slope as the chamfered edge 208*a* to provide a substantially uniform or consistent appearance for the bi-metallic containment ring 200. The fourth side 228 is coupled to the first portion 202 when the bi-metallic containment ring 200 is assembled. The bore 229 is defined adjacent to the second side 224 and is sized to enable the bi-metallic containment ring 200 to be positioned within the gas turbine engine 10 (FIG. 1).

The second retaining flange 216 can extend downwardly or radially inward from the second side 220 of the second annular body 212, and can define an aft retaining flange with regard to the location of the second retaining flange 216 relative to the longitudinal centerline axis C. The second retaining flange 216 can include a first side 230, a second side 232, a third side 234, a fourth side 236 and defines a bore 237. The first side 230 is coupled to the second side 220 of the second annular body 212. The second side 232 is coupled to the first side 230 of the second retaining flange 216 and the third side 234. The second side 232 forms a terminal end of the second retaining flange 216. The second side 232 extends radially outward for a distance from the second inner diameter D6 to a lip or extension generally indicated by reference numeral 232*a* near the terminal end that can aid in retaining the turbine disks 38 and turbine blades 40. Generally, the second side 232 extends radially for a distance such that the second side 232 is substantially coplanar with the second side 224 of the first retaining flange 214 when viewed in cross-section.

The third side 234 is coupled to the second side 232, and is generally opposite the first side 230. The third side 234 includes a chamfered edge 234*a*, which tapers from the third side 234 to the fourth side 236 to interconnect the third side 234 and the fourth side 236. The chamfered edge 234*a* can taper at substantially the same slope as the chamfered edge 210*a* to provide a substantially uniform or consistent appearance for the bi-metallic containment ring 200. The fourth side 236 is coupled to the first portion 202 when the bi-metallic containment ring 200 is assembled. The bore 237 is defined adjacent to the second side 232 and is sized to enable the bi-metallic containment ring 200 to be positioned within the gas turbine engine 10 (FIG. 1).

The first portion 202 of the bi-metallic containment ring 200 is coupled to the second portion 204 of the bi-metallic containment ring 200 through any suitable technique. For example, the first portion 202 and the second portion 204 can be formed separately and machined such that the first inner diameter D5 of the first portion 202 is substantially similar to the second outer diameter D8 of the second portion 204. Then, the first portion 202 is heated and the second portion 204 is chilled to enable the second portion 204 to be received within the first portion 202 to form an interference fit between the first portion 202 and the second portion 204 once assembled. Alternatively, the first portion 202 and the second portion 204 can be coupled together via an inertia weld, in which one of the first portion 202 and the second portion 204 is held fixed while the other of the first portion 202 and the second portion 204 is rotated or spun. Then, the fixed one of the first portion 202 and the second portion 204 can be inserted or pressed into the spun one of the first portion 202 and the second portion 204 to form the inertia weld between the first portion 202 and the second portion 204. As a further alternative, the first portion 202 and the second portion 204 can be coupled together via mechanical fasteners, such as one or more pins. The one or more pins can be inserted through the first portion 202 and the second portion 204 at various locations along the diameter of the respective first portion 202 and the second portion 204. Coupling the first portion 202 and the second portion 204 with mechanical fasteners, such as pins, can enable the second portion 204 to move or rotate within the first portion 202, which can absorb energy during a containment event. In addition, the first portion 202 and the second portion 204 can be coupled together via hot isostatic pressing (HIP), as known to one skilled in the art.

With the first portion 202 coupled to the second portion 204 to define the bi-metallic containment ring 200, the bi-metallic containment ring 200 can be coupled to the gas turbine engine 10 so as to be positioned about a desired one or more of the turbine disks 38. During an event requiring containment of the turbine blades 40 and turbine disks 38, as the second material of the second portion 204 has a higher strength than the first material, the second portion 204 absorbs a significant amount of energy. If the second portion 204 fractures, the ductility of the first material of the first portion 202 enables the first portion 202 to expand and absorb energy to contain the turbine blades 40 and turbine disks 38. Thus, the bi-metallic containment ring 200 having the first portion 202 of the first, ductile material and the second portion 204 of the second, high strength material meets the requirements for containment, while providing a reduced mass of the bi-metallic containment ring 200. The reduced mass can provide weight savings for the gas turbine engine 10 and a vehicle employing the gas turbine engine 10 (FIG. 1).

The bi-metallic containment ring 12 discussed with regard to FIGS. 1-3 is merely one example of a bi-metallic containment ring that can be employed with the gas turbine engine 10. In accordance with various embodiments, with reference to FIG. 6, a side view of a bi-metallic containment ring 300 is shown. The bi-metallic containment ring 300 can be used with the gas turbine engine 10 in similar fashion to the bi-metallic containment ring 12 discussed above with regard to FIGS. 1-3, and further, the gas turbine engine 10 can include both the bi-metallic containment ring 12, the bi-metallic containment ring 200 and the bi-metallic containment ring 300, if desired. Thus, the gas turbine engine 10 need not employ a single type of bi-metallic containment ring 12, 200, 300.

The bi-metallic containment ring 300 comprises a first portion 302 composed of a first material and a second portion 304 composed of a second, different material. In one example, the first portion 302 is composed of a high ductility and a low strength material. For example, the first portion 302 is composed of a material having a ductility or percent elongation of greater than about 40% elongation and a strength of less than about 100 kilopound per square inch (ksi). Exemplary materials for the first portion 302 can comprise Inconel® alloy 625 (IN625), CRES 347 stainless steel, etc.

In one example, the second portion 304 is composed of a low ductility and a high strength material. For example, the second portion 304 is composed of a material having a ductility or percent elongation of less than about 30% elongation and a strength of greater than about 150 kilopound per square inch (ksi). Exemplary materials for the second portion 304 can comprise Inconel® alloy 718 (IN718), Steel 17-4 PH®, etc. In one example, the first material of the first portion 302 can comprise about 25 percent by volume to about 75 percent by volume of the mass of the bi-metallic containment ring 300, and the second material of the second portion 304 can comprise about 75 percent by volume to about 25 percent by volume of the mass of the bi-metallic containment ring 300. Stated another way, the volume of the first material of the first portion 302 and the second material of the second portion 304 can be optimized to provide containment while minimizing a mass of the bi-metallic containment ring 300.

Figure 6:
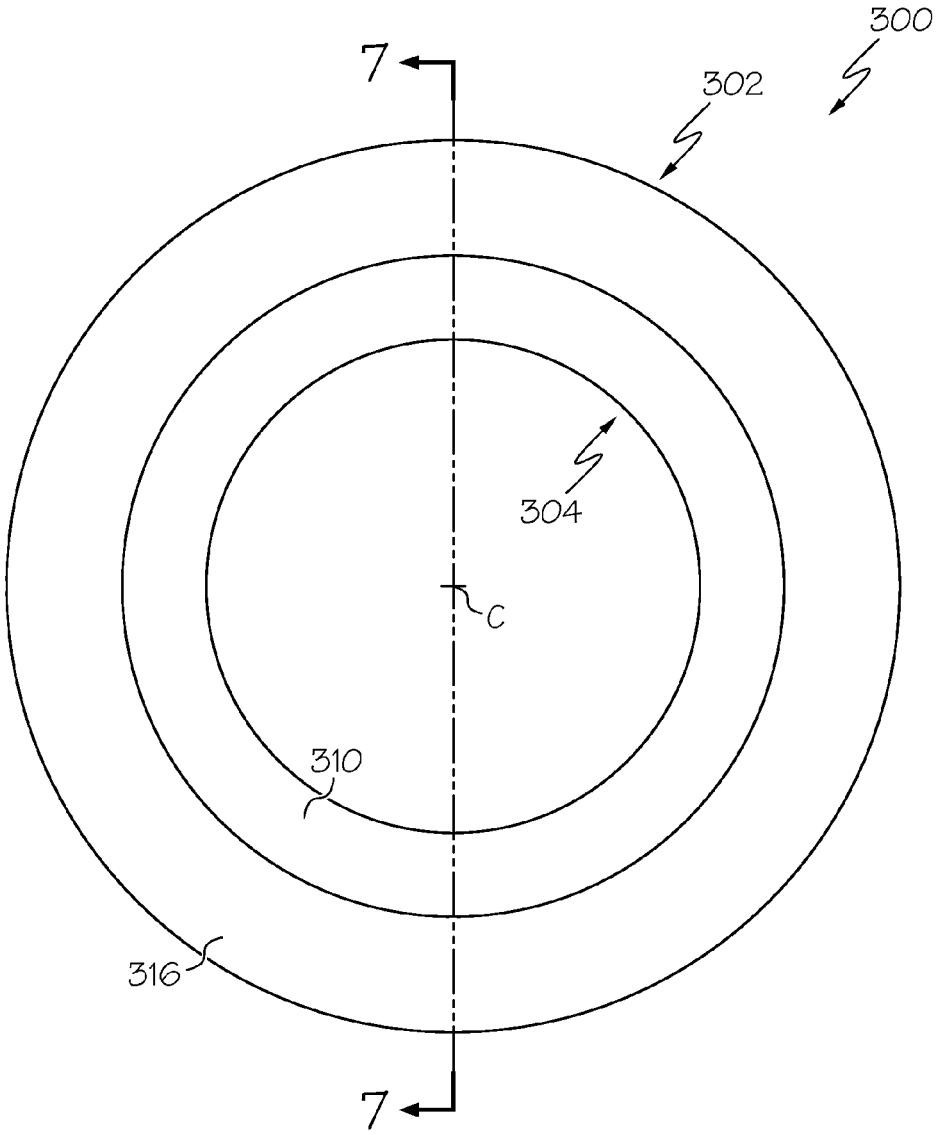
FIG. 6 is a front side view of an exemplary bi-metallic containment ring for use with the gas turbine engine of FIG. 1.
Figure 7:
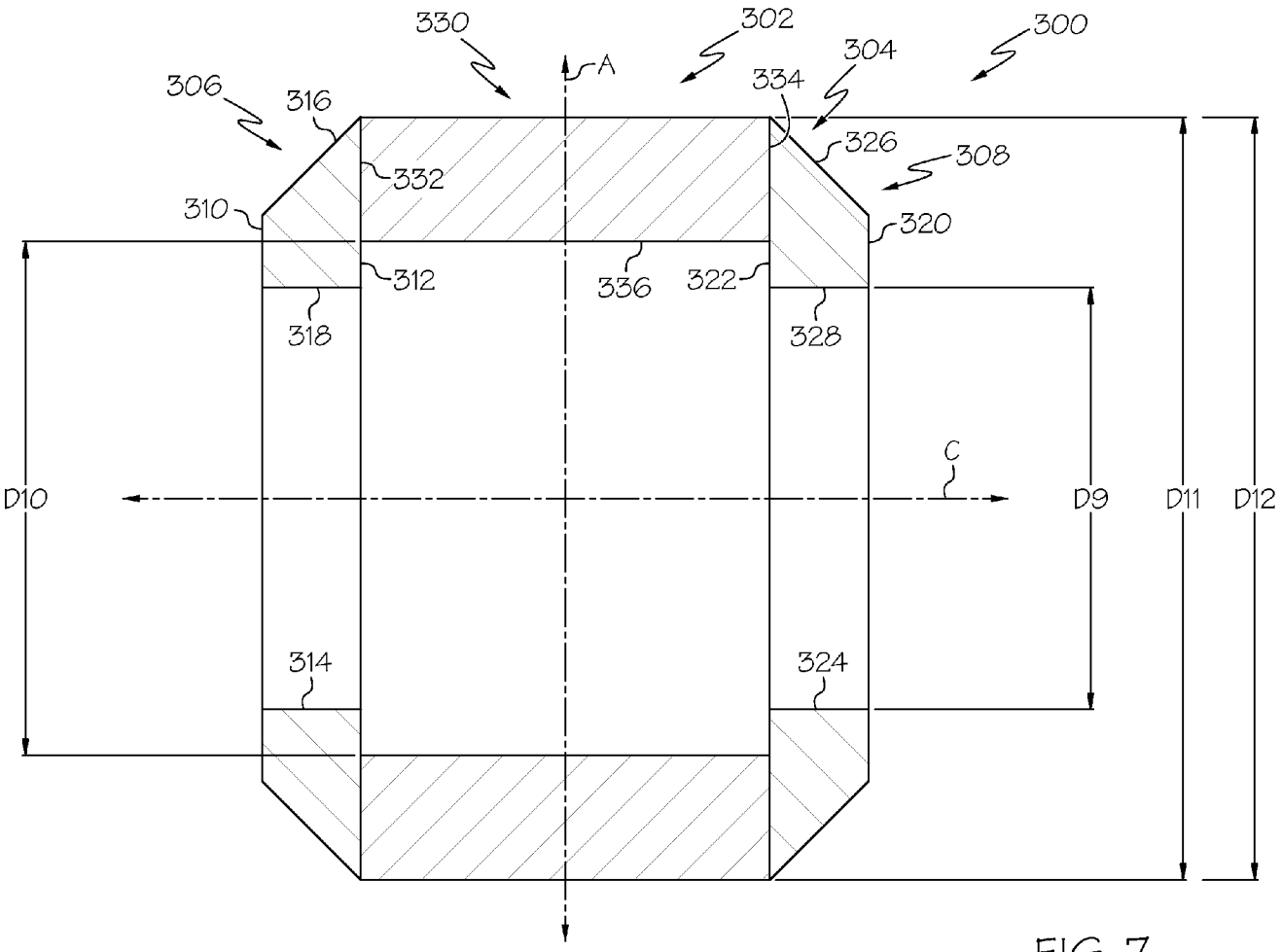
FIG. 7 is a cross-sectional view of the bi-metallic containment ring of FIG. 4, taken along line 7-7 of FIG. 6.

With reference to FIG. 7, FIG. 7 is a cross-sectional view taken through the side view of FIG. 6, which illustrates the bi-metallic containment ring 300 as positioned about the longitudinal centerline of the gas turbine engine 10. In FIG. 7, the first portion 302 comprises a ring having an inner diameter D10 and an outer diameter D12. It should be noted that while the first portion 302 is described and illustrated herein as having a ring shape with a constant or uniform cross-section, the first portion 302 can have any desired shape. The first portion 302 can be substantially symmetric with respect to the longitudinal centerline axis C of the gas turbine engine 10 (FIG. 1), and can be substantially symmetric with the longitudinal axis A of the bi-metallic containment ring 300.

The first portion 302 can include an annular body 330. The annular body 330 can comprise a single piece, formed through a suitable forming process, such as casting, machining, etc. The annular body 330 can include a first side 332 opposite a second side 334, and can define a bore 336. The first side 332 and the second side 334 are each coupled to the second portion 304. The bore 336 is sized to enable the bi-metallic containment ring 300 to be positioned about the turbine disks 38 and turbine blades 40.

The second portion 304 comprises a first ring 306 and a second ring 308. Each of the first ring 306 and the second ring 308 has an inner diameter D9 and an outer diameter D11. The inner diameter D9 of the first ring 306 and the inner diameter D9 of the second ring 308 can be substantially the same, and the outer diameter D11 of the first ring 306 and the outer diameter D11 of the second ring 308 can be substantially the same. The inner diameter D10 of the first portion 302 can be larger than the inner diameter D9 of the second portion 304, and the outer diameter D12 can be about equal to the outer diameter D11 of the second portion 304.

The first ring 306 can comprise a single piece annular body, which can be formed through a suitable forming process, such as casting, machining, etc. The first ring 306 can be substantially symmetric with respect to the longitudinal centerline axis C of the gas turbine engine 10 (FIG. 1), and the second portion 304 can be substantially symmetric with the longitudinal axis A of the bi-metallic containment ring 300. The first ring 306 can be substantially uniform, and can include a first surface 310 opposite a second surface 312. A bore 314 can be defined through the first surface 310 and the second surface 312. The bore 314 enables the bi-metallic containment ring 300 to be positioned within the gas turbine engine 10 (FIG. 1).

The first surface 310 can be substantially planar, and can be coupled to the second surface 312 via a tapered surface 316 and a sidewall 318. The tapered surface 316 can slope from the first surface 310 to the second surface 312. The sidewall 318 extends along the perimeter of the bore 314 and is substantially cylindrical. The second surface 312 is substantially planar, and is coupled to the first portion 302.

The second ring 308 can comprise a single piece annular body, which can be formed through a suitable forming process, such as casting, machining, etc. The second ring 308 can be substantially symmetric with respect to the longitudinal centerline axis C of the gas turbine engine 10 (FIG. 1). The second ring 308 can be substantially uniform, and can include a first surface 320 opposite a second surface 322. A bore 324 can be defined through the first surface 320 and the second surface 322. The bore 324 enables the bi-metallic containment ring 300 to be positioned within the gas turbine engine 10 (FIG. 1).

The first surface 320 can be substantially planar, and can be coupled to the second surface 322 via a tapered surface 326 and a sidewall 328. The tapered surface 326 can slope from the first surface 320 to the second surface 322. The sidewall 328 extends along the perimeter of the bore 324 and is substantially cylindrical. The second surface 322 is substantially planar, and is coupled to the first portion 302.

The first portion 302 of the bi-metallic containment ring 300 is coupled to the second portion 304 of the bi-metallic containment ring 300 through any suitable technique. For example, the first portion 302 and the second portion 304 can be coupled together via an inertia weld, in which one of the first portion 302 and the second portion 304 (first ring 306 and second ring 308) is held fixed while the other of the first portion 302 and the second portion 304 (first ring 306 and second ring 308) is rotated or spun. Then, the fixed one of the first portion 302 and the second portion 304 (first ring 306 and second ring 308) can be inserted or pressed into the spun one of the first portion 302 and the second portion 304 (first ring 306 and second ring 308) to form the inertia weld between the first portion 302 and the second portion 304 (first ring 306 and second ring 308). Alternatively, the first ring 306, the second ring 308 and the first portion 302 can be coupled together via mechanical fasteners, such as one or more pins. The one or more pins can be inserted through the first ring 306, the second ring 308 and the first portion 302 at various locations along the diameter of the respective first ring 306, second ring 308 and the first portion 302 to couple each of the first ring 306 and the second ring 308 to the first portion 302. Coupling the first portion 302 and the second portion 304 with mechanical fasteners, such as pins, can enable the second portion 304 to move or rotate relative to the first portion 302, which can absorb energy during a containment event. In addition, the first portion 302 and the second portion 304 can be coupled together via hot isostatic pressing (HIP), as known to one skilled in the art.

With the first portion 302 coupled to the second portion 304 to define the bi-metallic containment ring 300, the bi-metallic containment ring 300 can be coupled to the gas turbine engine 10 so as to be positioned about a desired one or more of the turbine disks 38. During an event requiring containment of the turbine blades 40 and turbine disks 38, as the second material of the second portion 304 has a higher strength than the first material, the second portion 304 absorbs a significant amount of energy to assist in containing the turbine blades 40 and turbine disks 38 during an event. The first material of the first portion 302 enables the first portion 302 to expand and absorb energy to contain the turbine blades 40 and turbine disks 38. Thus, the bi-metallic containment ring 300 having the first portion 302 of the first, ductile material and the second portion 304 of the second, high strength material meets the requirements for containment, while providing a reduced mass of the bi-metallic containment ring 300. The reduced mass can provide weight savings for the gas turbine engine 10 and a vehicle employing the gas turbine engine 10 (FIG. 1).

The bi-metallic containment ring 12 discussed with regard to FIGS. 1-3 is merely one example of a bi-metallic containment ring that can be employed with the gas turbine engine 10. In accordance with various embodiments, with reference to FIG. 8, a side view of a bi-metallic containment ring 400 is shown. The bi-metallic containment ring 400 can be used with the gas turbine engine 10 in similar fashion to the bi-metallic containment ring 12 discussed above with regard to FIGS. 1-3, and further, the gas turbine engine 10 can include both the bi-metallic containment ring 12, the bi-metallic containment ring 200, the bi-metallic containment ring 300 and the bi-metallic containment ring 400, if desired. Thus, the gas turbine engine 10 need not employ a single type of bi-metallic containment ring 12, 200, 300, 400.

The bi-metallic containment ring 400 comprises a first portion 402 composed of a first material and a second portion 404 composed of a second, different material. In one example, the first portion 402 is composed of a high ductility and a low strength material. For example, the first portion 402 is composed of a material having a ductility or percent elongation of greater than about 40% elongation and a strength of less than about 100 kilopound per square inch (ksi). Exemplary materials for the first portion 402 can comprise Inconel® alloy 625 (IN625), CRES 347 stainless steel, etc.

In one example, the second portion 404 is composed of a low ductility and a high strength material. For example, the second portion 404 is composed of a material having a ductility or percent elongation of less than about 30% elongation and a strength of greater than about 150 kilopound per square inch (ksi). Exemplary materials for the second portion 404 can comprise Inconel® alloy 718 (IN718), Steel 17-4 PH®, etc. In one example, the first material of the first portion 402 can comprise about 25 percent by volume to about 75 percent by volume of the mass of the bi-metallic containment ring 400, and the second material of the second portion 404 can comprise about 75 percent by volume to about 25 percent by volume of the mass of the bi-metallic containment ring 400. Stated another way, the volume of the first material of the first portion 402 and the second material of the second portion 404 can be optimized to provide containment while minimizing a mass of the bi-metallic containment ring 400.

Figure 8:
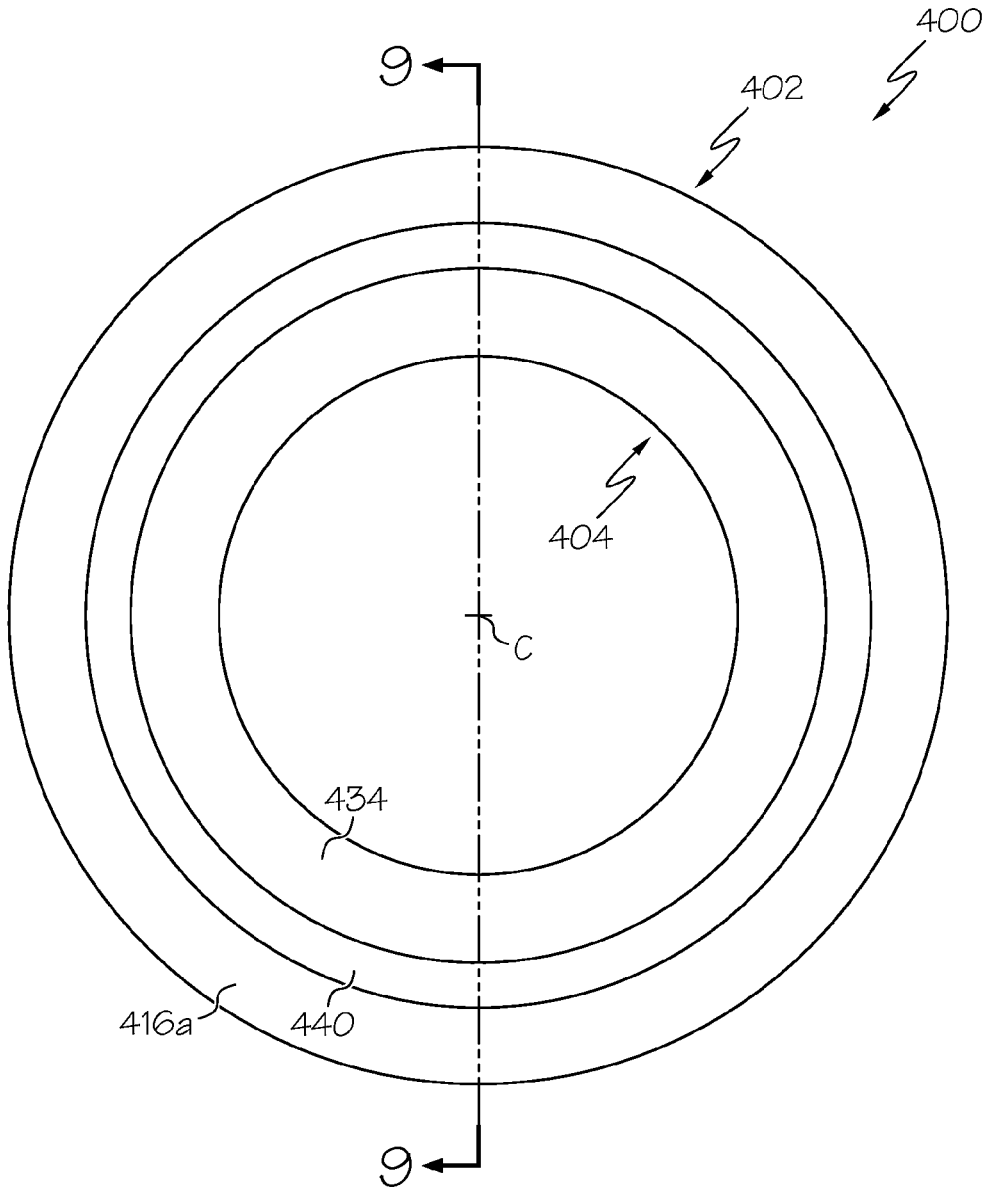
FIG. 8 is a front side view of an exemplary bi-metallic containment ring for use with the gas turbine engine of FIG. 1.
Figure 9:
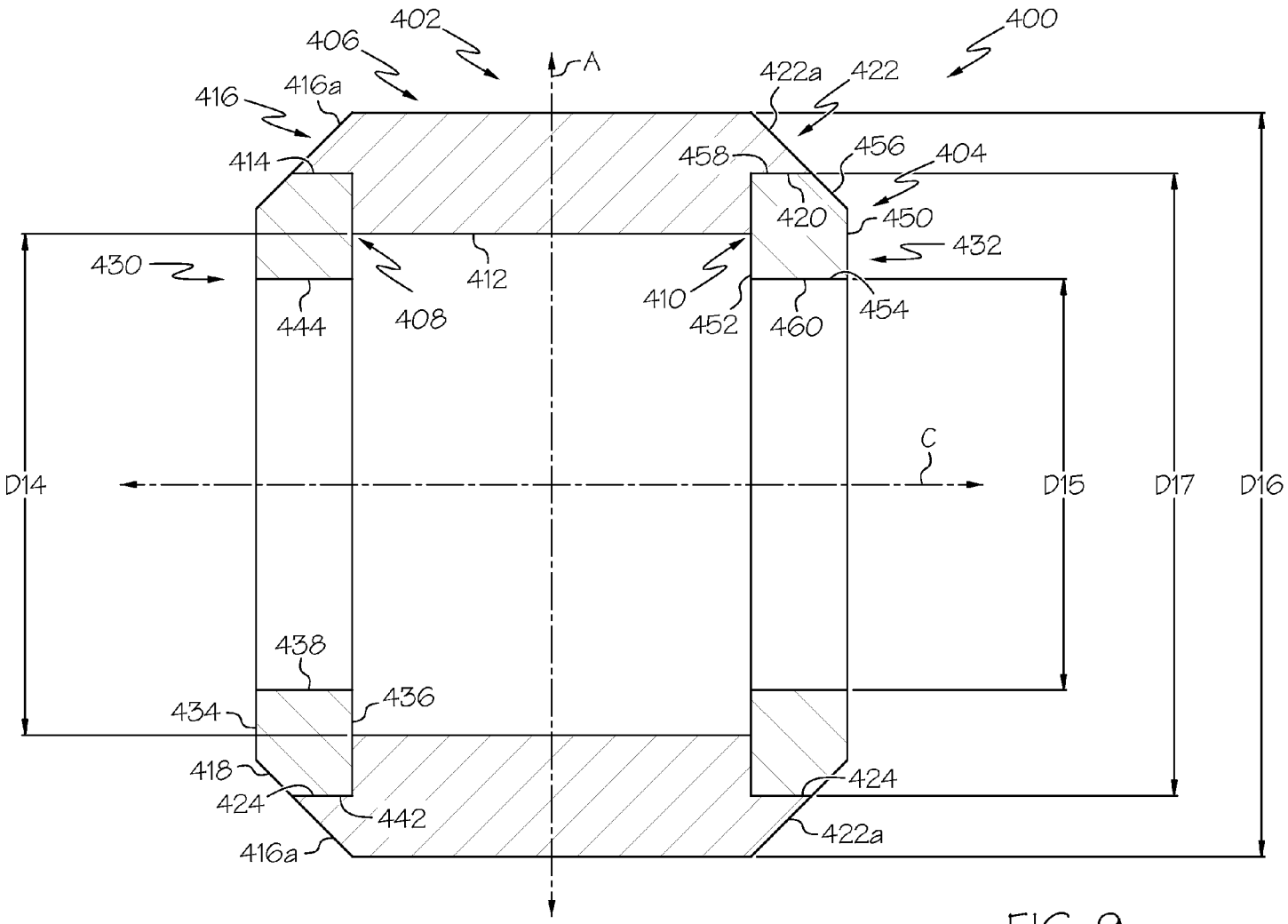
FIG. 9 is a cross-sectional view of the bi-metallic containment ring of FIG. 8, taken along line 9-9 of FIG. 8.

With reference to FIG. 9, FIG. 9 is a cross-sectional view taken through the side view of FIG. 8, which illustrates the bi-metallic containment ring 400 as positioned about the longitudinal centerline of the gas turbine engine 10. In FIG. 9, the first portion 402 comprises a ring having an inner diameter D14 and an outer diameter D16. It should be noted that while the first portion 402 is described and illustrated herein as having a ring shape, the first portion 402 can have any desired shape. The first portion 402 can be substantially symmetric with respect to the longitudinal centerline axis C of the gas turbine engine 10 (FIG. 1), and can be substantially symmetric with the longitudinal axis A of the bi-metallic containment ring 400.

The first portion 402 can include an annular body 406, having substantially a T-shape in cross-section. The annular body 406 can comprise a single piece ring, formed through a suitable forming process, such as casting, machining, etc. The annular body 406 can include a first side 408 opposite a second side 410, and can define a bore 412. The first side 408 defines a counterbore 414 and a projection 416. The counterbore 414 is defined through the first side 408 along a sidewall 418 and results in the projection 416. The projection 416 is coupled to the second portion 404 to couple the second portion 404 to the first portion 402. The projection 416 includes a tapered surface 416*a*, which tapers from the sidewall 418 to the outer diameter D16.

The second side 410 defines a counterbore 420 and a projection 422. The counterbore 420 is defined through the second side 410 along a sidewall 424 and results in the projection 422. The projection 422 is coupled to the second portion 404 to couple the second portion 404 to the first portion 402. The projection 422 includes a tapered surface 422*a*, which tapers from the sidewall 424 to the outer diameter D16. The bore 412 is sized to enable the bi-metallic containment ring 400 to be positioned about the turbine disks 38 and turbine blades 40.

The second portion 404 comprises a first ring 430 and a second ring 432. Each of the first ring 430 and the second ring 432 has an inner diameter D15 and an outer diameter D17. The inner diameter D15 of the first ring 430 and the inner diameter D15 of the second ring 432 can be substantially the same, and the outer diameter D17 of the first ring 430 and the outer diameter D17 of the second ring 432 can be substantially the same. The inner diameter D14 of the first portion 402 can be larger than the inner diameter D15 of the second portion 404, and the outer diameter D16 can be larger than the outer diameter D17 of the second portion 404.

The first ring 430 can comprise a single piece annular body, which can be formed through a suitable forming process, such as casting, machining, etc. The first ring 430 can be substantially symmetric with respect to the longitudinal centerline axis C of the gas turbine engine 10 (FIG. 1), and the second portion 404 can be substantially symmetric with the longitudinal axis A of the bi-metallic containment ring 400. The first ring 430 can be substantially uniform, and can include a first surface 434 opposite a second surface 436. A bore 438 can be defined through the first surface 434 and the second surface 436. The bore 438 enables the bi-metallic containment ring 400 to be positioned within the gas turbine engine 10 (FIG. 1).

The first surface 434 can be substantially planar, and can be coupled to the second surface 436 via a tapered surface 440, a coupling surface 442 and a sidewall 444. The tapered surface 440 can slope from the first surface 434 to the coupling surface 442. The tapered surface 440 can have a slope that is about equal to the slope of the tapered surface 416*a* to provide a consistent or uniform appearance for the bi-metallic containment ring 400. The coupling surface 442 can be substantially planar in cross-section, and can be coupled to the sidewall 418 of the first portion 402. The sidewall 444 extends along the perimeter of the bore 438 and is substantially cylindrical. The second surface 436 is substantially planar, and is coupled to the first portion 402. Generally, the first ring 430 can be coupled to the annular body 406 of the first portion 402 so as to be received in the counterbore 414 of the first side 408.

The second ring 432 can comprise a single piece annular body, which can be formed through a suitable forming process, such as casting, machining, etc. The second ring 432 can be substantially symmetric with respect to the longitudinal centerline axis C of the gas turbine engine 10 (FIG. 1). The second ring 432 can be substantially uniform, and can include a first surface 450 opposite a second surface 452. A bore 454 can be defined through the first surface 450 and the second surface 452. The bore 454 enables the bi-metallic containment ring 400 to be positioned within the gas turbine engine 10 (FIG. 1).

The first surface 450 can be substantially planar, and can be coupled to the second surface 452 via a tapered surface 456, a coupling surface 458 and a sidewall 460. The tapered surface 456 can slope from the first surface 450 to the coupling surface 458. The tapered surface 456 can have a slope that is about equal to the slope of the tapered surface 422*a* to provide a consistent or uniform appearance for the bi-metallic containment ring 400. The coupling surface 458 can be substantially planar in cross-section, and can be coupled to the sidewall 424 of the first portion 402. The sidewall 460 extends along the perimeter of the bore 454 and is substantially cylindrical. The second surface 452 is substantially planar, and is coupled to the first portion 402. Generally, the second ring 432 can be coupled to the annular body 406 of the first portion 402 so as to be received in the counterbore 420 of the second side 410.

The first portion 402 of the bi-metallic containment ring 400 is coupled to the second portion 404 of the bi-metallic containment ring 400 through any suitable technique. For example, the first portion 402 and the second portion 404 can be coupled together via an inertia weld, in which one of the first portion 402 and the second portion 404 (first ring 430 and second ring 432) is held fixed while the other of the first portion 402 and the second portion 404 (first ring 430 and second ring 432) is rotated or spun. Then, the fixed one of the first portion 402 and the second portion 404 (first ring 430 and second ring 432) can be inserted or pressed into the spun one of the first portion 402 and the second portion 404 (first ring 430 and second ring 432) to form the inertia weld between the first portion 402 and the second portion 404 (first ring 430 and second ring 432). Alternatively, the first ring 430, the second ring 432 and the first portion 402 can be coupled together via mechanical fasteners, such as one or more pins. The one or more pins can be inserted through the first ring 430, the second ring 432 and the first portion 402 at various locations along the diameter of the respective first ring 430, second ring 432 and the first portion 402 to couple each of the first ring 430 and the second ring 432 to the first portion 402. Coupling the first portion 402 and the second portion 404 with mechanical fasteners, such as pins, can enable the second portion 404 to move or rotate relative to the first portion 402, which can absorb energy during a containment event. In addition, the first portion 402 and the second portion 404 can be coupled together via hot isostatic pressing (HIP), as known to one skilled in the art.

With the first portion 402 coupled to the second portion 404 to define the bi-metallic containment ring 400, the bi-metallic containment ring 400 can be coupled to the gas turbine engine 10 so as to be positioned about a desired one or more of the turbine disks 38. During an event requiring containment of the turbine blades 40 and turbine disks 38, as the second material of the second portion 404 has a higher strength than the first material, the second portion 404 absorbs a significant amount of energy to assist in containing the turbine blades 40 and turbine disks 38 during an event. The first material of the first portion 402 enables the first portion 402 to expand and absorb energy to contain the turbine blades 40 and turbine disks 38. Thus, the bi-metallic containment ring 400 having the first portion 402 of the first, ductile material and the second portion 404 of the second, high strength material meets the requirements for containment, while providing a reduced mass of the bi-metallic containment ring 400. The reduced mass can provide weight savings for the gas turbine engine 10 and a vehicle employing the gas turbine engine 10.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A containment ring, comprising:

a first portion including a first ring composed of a first material having a first ductility, the first ring having an annular body and a retaining flange that extends radially inward from the annular body; and a second portion coupled to the first ring, the second portion composed of a second material having a second ductility that is less than the first ductility and the first ductility is greater than about forty percent elongation, the second portion comprises a second ring, the second ring has a second annular body and a second retaining flange, the second annular body having a first side opposite a second side, the first side coupled to the second retaining flange and the second side coupled to the retaining flange, and the second retaining flange extends radially inward from the second annular body.

2. The containment ring of claim 1, wherein the second ring is positioned concentrically within the first ring.

3. The containment ring of claim 2, wherein the first ring and the second ring have an L-shaped cross-section.

4. The containment ring of claim 1, wherein the first material is selected from the group comprising Inconel alloy 625 and CRES 347 stainless steel.

5. The containment ring of claim 1, wherein the second material is selected from the group comprising Inconel alloy 718 and Steel 17-4 PH.

6. A containment ring, comprising:

a first ring composed of a first material having a first ductility and a first strength, the first ring having an annular body and a retaining flange that extends radially inward from the annular body; and a second ring coupled to the first ring, the second ring composed of a second material having a second ductility that is different than the first ductility and a second strength that is different than the first strength, the second ring has a second annular body and a second retaining flange, the second annular body having a first side opposite a second side, the first side coupled to the second retaining flange and the second side coupled to the retaining flange, and the second retaining flange extends radially inward from the second annular body, wherein the first ductility is greater than about forty percent elongation and the first strength is less than about 100 kilopound per square inch.

7. The containment ring of claim 6, wherein the second ring is positioned concentrically within the first ring.

8. The containment ring of claim 6, wherein the first ring and the second ring have an L-shaped cross-section.

9. The containment ring of claim 6, wherein the first material is selected from the group comprising Inconel alloy 625 and CRES 347 stainless steel.

10. The containment ring of claim 6, wherein the second material is selected from the group comprising Inconel alloy 718 and Steel 17-4 PH.

11. A containment ring, comprising:

a first ring composed of a first metal having a first ductility, the first ring having a first surface opposite a second surface, a first outer diameter and defining a first bore with a first inner diameter;

a second ring coupled to the first surface of the first ring, the second ring composed of a second metal having a second ductility that is different than the first ductility and the first ductility is greater than about forty percent elongation, the second ring having a second outer diameter and defining a second bore with a second inner diameter that is less than the first inner diameter, the first outer diameter is substantially equal to the second outer diameter; and a third ring coupled to the second surface of the first ring, the third ring composed of the second metal and defining a third bore with a third inner diameter, the third inner diameter substantially equal to the second inner diameter.

12. The containment ring of claim 11, wherein the first surface and the second surface of the first ring each include a counterbore, with the second ring received in the counterbore of the first surface and the third ring received in the counterbore of the second surface.

13. The containment ring of claim 11, wherein the first metal is selected from the group comprising Inconel alloy 625 and CRES 347 stainless steel.

14. The containment ring of claim 11, wherein the second metal is selected from the group comprising Inconel alloy 718 and Steel 17-4 PH.

* * * * *